US007677322B2

(12) United States Patent
Jordan et al.

(10) Patent No.: US 7,677,322 B2
(45) Date of Patent: Mar. 16, 2010

(54) SYSTEM AND METHOD FOR A LOW DRAG FLOTATION SYSTEM

(75) Inventors: Andrew K. Jordan, Magnolia, TX (US); Alvaro Jose Vilela, Rio de Janeiro (BR); Frederico Carvalho, Rio de Janeiro (BR)

(73) Assignee: BJ Services Company, Houston, TX (US)

( * ) Notice: Subject to any disclaimer, the term of this patent is extended or adjusted under 35 U.S.C. 154(b) by 67 days.

(21) Appl. No.: 12/027,869

(22) Filed: Feb. 7, 2008

(65) Prior Publication Data

US 2008/0185157 A1 Aug. 7, 2008

Related U.S. Application Data

(60) Provisional application No. 60/899,998, filed on Feb. 7, 2007.

(51) Int. Cl.
*E21B 43/10* (2006.01)

(52) U.S. Cl. ..... 166/380; 166/381; 166/192; 166/386

(58) Field of Classification Search ..... 166/380, 166/381, 386, 192, 285, 77.1, 165
See application file for complete search history.

(56) References Cited

U.S. PATENT DOCUMENTS

| | | | | |
|---|---|---|---|---|
| 4,986,361 | A | 1/1991 | Mueller et al. | 166/381 |
| 5,409,061 | A | 4/1995 | Bullick | 166/278 |
| 5,456,317 | A | 10/1995 | Hood, III et al. | 166/296 |
| 5,829,526 | A | 11/1998 | Rogers et al. | 166/291 |
| 6,634,430 | B2 * | 10/2003 | Dawson et al. | 166/381 |
| 2007/0295513 | A1 * | 12/2007 | Biegler et al. | 166/381 |

OTHER PUBLICATIONS

Davis Extended Research Equipment, Davis Flotation Collar, Davis-Lynch, Inc., 1-pg.
PCT International Search Report and Written Opinion dated Jul. 9, 2008, for corresponding PCT/US2008/053328.

* cited by examiner

*Primary Examiner*—Kenneth Thompson
(74) *Attorney, Agent, or Firm*—Howrey LLP

(57) ABSTRACT

A low drag flotation system for placing screens in horizontal wells is provided which includes a screen exterior to the washpipe to be placed for sand control, and hydraulically actuated valves for trapping air within the washpipe. The air in the washpipe creates a buoyancy force that decreases the drag force of the pipe string in the horizontal well, allowing it to move further down the well under its own weight. As a result, screens can be placed in longer lengths of horizontal wells to maximize oil and gas production.

7 Claims, 7 Drawing Sheets

SYSTEM AND METHOD FOR A LOW DRAG FLOTATION SYSTEM

BACKGROUND OF THE INVENTION

1. Field of the Invention

The present invention relates generally to a screen placement system for an oil and gas well. More particularly, the present invention relates to a low drag flotation system for placing a screen assembly in a horizontal well.

2. Description of the Related Art

It is often desirable in the oilfield industry to drill horizontal wells to produce oil and gas. Longer horizontal sections maximize oil and gas recovery from these wells and are thus in longer lengths. These horizontal wells may either be cased holes or open holes.

It is also desirable to place screens in the horizontal wells to control the amount of sand entering the wellbore either from an open hole or perforations in a cased hole. This protects well equipment and surface equipment from sand damage. The screen assemblies, either stand-alone or gravel packed, traditionally include a screen with a washpipe inside to facilitate fluid circulation down to the bottom of the well and back up the annulus, or vice-versa. The screen assemblies are run into the well attached to a workstring, the weight of the workstring provides the necessary force to move the screen and washpipe through both the vertical and horizontal portions of the well. Once the screen is placed in the horizontal section of the well and the necessary fluid circulations are complete, the washpipe is removed from the assembly and the sand from the formation can be controlled during oil or gas production.

There is a drawback in the traditional placement of screens in a horizontal well. The weight of the workstring must be sufficient to provide a downward force that overcomes the frictional force produced by the screens rubbing against the bottom of the horizontal well bore. When the geometry conditions of the horizontal section of the well bore, such as length, tortuous and open hole caliper and others, become severe enough to create a frictional force that cannot be overcome by the workstring weight, the workstring, and thus the screen, cannot be advanced any further into the well. This may lead to damage of the screen shrouds due to the drag forces generated by the well geometry. This is obviously a limitation to the extent at which screens may be placed in a horizontal well and hinders maximum oil and gas recovery from the formation.

Thus, there is a need for an improved system and process for placing screens in a horizontal well (or an extended reach well that is subject to high drag forces).

SUMMARY OF THE INVENTION

According to one embodiment of the present invention, a low drag flotation system (LDFS) and related method is provided for installing a screen assembly in a horizontal well. The system includes the screen assembly and a washpipe assembly positioned inside the screen assembly. The screen assembly includes a sand control screen, a gravel pack packer, closing sleeve, fluid loss control device and extensions. The washpipe assembly comprises a washpipe, a hydraulically actuated valve connected proximate to the lower end of a washpipe, and a hydraulically or mechanically actuated valve proximate the upper end for trapping air or inert gas within the washpipe. The hydraulically actuated valves can take the form of differential valves and similar hydraulic devices. The upper hydraulically or mechanically actuated valves can take the form of mechanically actuated sleeves, rupture disks, differential valves and similar mechanic or hydraulic devices. The upper end of the washpipe is connected to a standard set-down weight gravel pack service tool. The service tool is connected to a workstring that extends to the surface. The service tool is releaseably connected to the gravel pack packer. The screen extends from the gravel pack system so that when the gravel pack packer is set, all formation fluids flow through the screens, through a closing sleeve below the gravel pack packer and circulates above the gravel packer annulus.

When the LDFS is introduced into a horizontal section of the well, air trapped within the washpipe creates a buoyant force which in turn reduces the normal force acting on the screen assembly. The reduced normal force results in a reduced drag or friction load that allows the system to move further along the horizontal well. As a result, screens used in accordance with the invention may be installed in longer lengths of complex horizontal wells than traditional screen assemblies. When the screens are positioned at the desired location, a pressure increase causes the hydraulically actuated valves to open. This allows the air trapped within the washpipe to be circulated out of the well. The washpipe assembly can then be retrieved and gravel pack treatment can be performed or screens can be set up into the horizontal section of the well as a stand alone assembly.

According to another embodiment, the means for trapping air or inert gas within the washpipe are mechanically actuated valves. The valve is closed at the surface to trap air or inert gas within the washpipe and is opened downhole after the screen is in place by mechanical means to allow the trapped air to be circulated out of the well. By way of example, the mechanically actuated valves may be actuated by manipulating the workstring by rotation and/or axial movement or by using a mechanical shifting tool. It will of course be appreciated by those of ordinary skill in the art that gases other than air (e.g., nitrogen) may be trapped within the washpipe to create the desired buoyant force.

According to a preferred embodiment of the invention, the LDFS works in conjunction with a standard completion system that may include a compression set packer, a closing sleeve, a circulating valve or closing sleeve, a fluid loss control device and a set-down weight gravel pack service tool.

The present invention includes a method for reducing the drag force on a pipe string while placing a screen assembly in a horizontal well. A preferred method comprises picking-up and making-up the desired length of the screen assembly and suspending the screen assembly in the rotary table of a drilling or workover rig. The method further includes picking-up and making-up a washpipe assembly. In a preferred embodiment, the washpipe assembly includes hydraulically or mechanically actuated valves that are installed at the surface to trap air (or other suitable gas) inside at least a portion of the washpipe. The washpipe assembly is positioned inside the screen assembly. The method further includes picking-up and making-up of a service tool that attaches to the screen and washpipe assemblies. The complete system is then run into the well on a workstring. The trapped air (or inert gas) in the washpipe allows the screen assembly to be at least partially floated through the horizontal section of the well bore. The screen assembly is set at the desired location within the horizontal section. The method further includes the steps of increasing pressure to open the hydraulically or mechanically actuated valves. The air trapped within the washpipe is then circulated out of the system.

Figure 1:
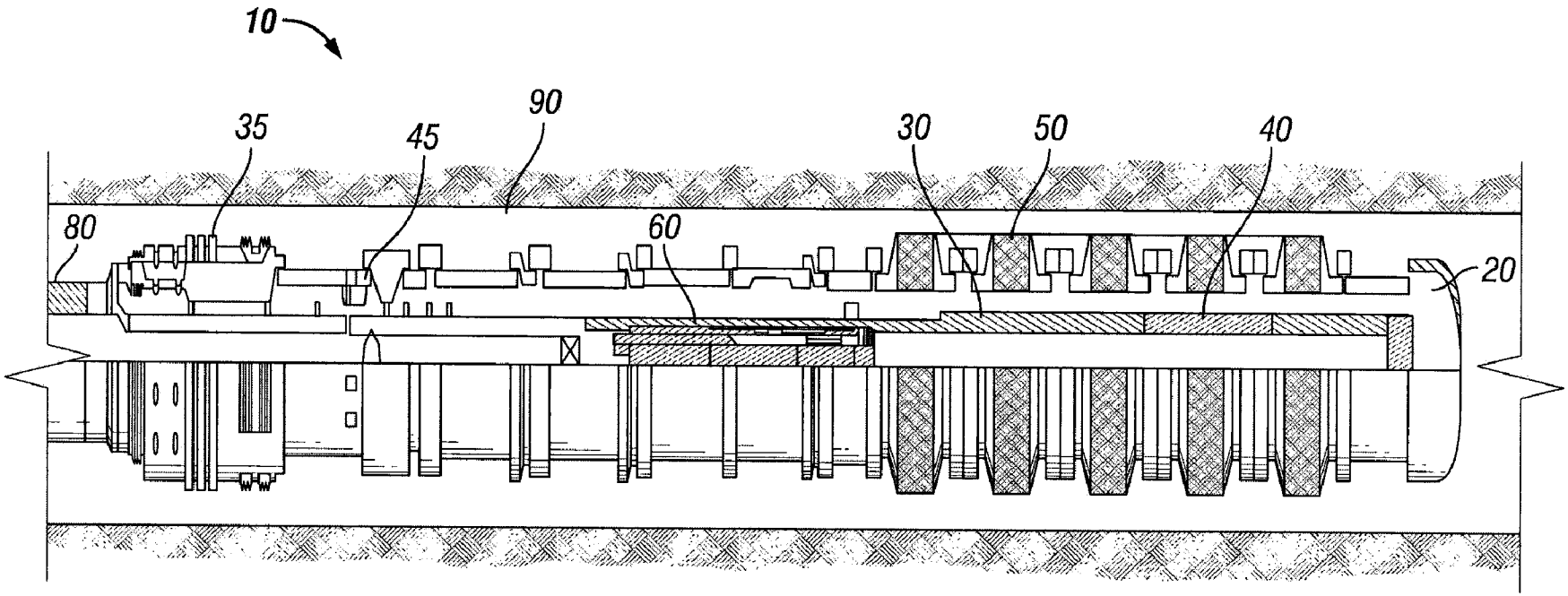
FIG. 1 is a cross sectional view of an exemplary embodiment of the low drag flotation system.

While the invention is susceptible to various modifications and alternative forms, specific embodiments and methods have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of a low drag flotation system. In the interest of clarity, not all features of an actual implementation or related method are described in this specification. It will of course be appreciated that in the development of any such actual embodiment or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1, one embodiment of a low drag flotation system (LDFS) 10 is illustrated in a horizontal well 90. A horizontal well, as used in this disclosure, refers to any deviated well in which drag forces are an issue. These wells can include, for example, any well which deviates from a true vertical axis more than 60 degrees. Those ordinarily skilled in the art having the benefit of this disclosure will understand that all such wells are encompassed by the term "horizontal well."

The LDFS 10 comprises a gravel pack assembly, washpipe assembly and a screen assembly. The washpipe assembly preferably includes a washpipe 30, and hydraulically actuated valves 40 and 60 for trapping air within the washpipe, depicted as a Lo Drag Flotation Valve and a Differential Valve. The washpipe assembly may include a cap on the lower end of the washpipe. In other embodiments, valve 40 may be located at the end portion of the washpipe. The upper end of the washpipe 30 is connected to a standard set-down weight gravel pack service tool 80 throughout the operation. The service tool is releasably connected to the gravel pack assembly. More particularly, the service tool is releaseably connected to a gravel pack packer 35. In one embodiment, the gravel pack packer 35 is a Comp Set II HP packer available from BJ Services Company. In addition to the gravel pack packer 35, the screen assembly may comprise a molded seal closing sleeve 45 attached to the gravel pack packer 35 and a desired length of screens 50. The closing sleeve 45 is a temporary flow path to the outside of the screen for fluid circulation and/or gravel placement, mechanically manipulated to the opened or closed position as required. The screen assembly typically includes a plurality of individual screens connected together by suitable connectors, such connectors being well known in the industry. A bull plug 20 is attached to the end of the screens.

One of skill in the art will appreciate that the LDFS 10 can be utilized in both cased wells and open hole wells. The system is especially well-suited for open hole wells due to the more unpredictable drag forces associated with the open hole sections of a well bore.

Figure 2:
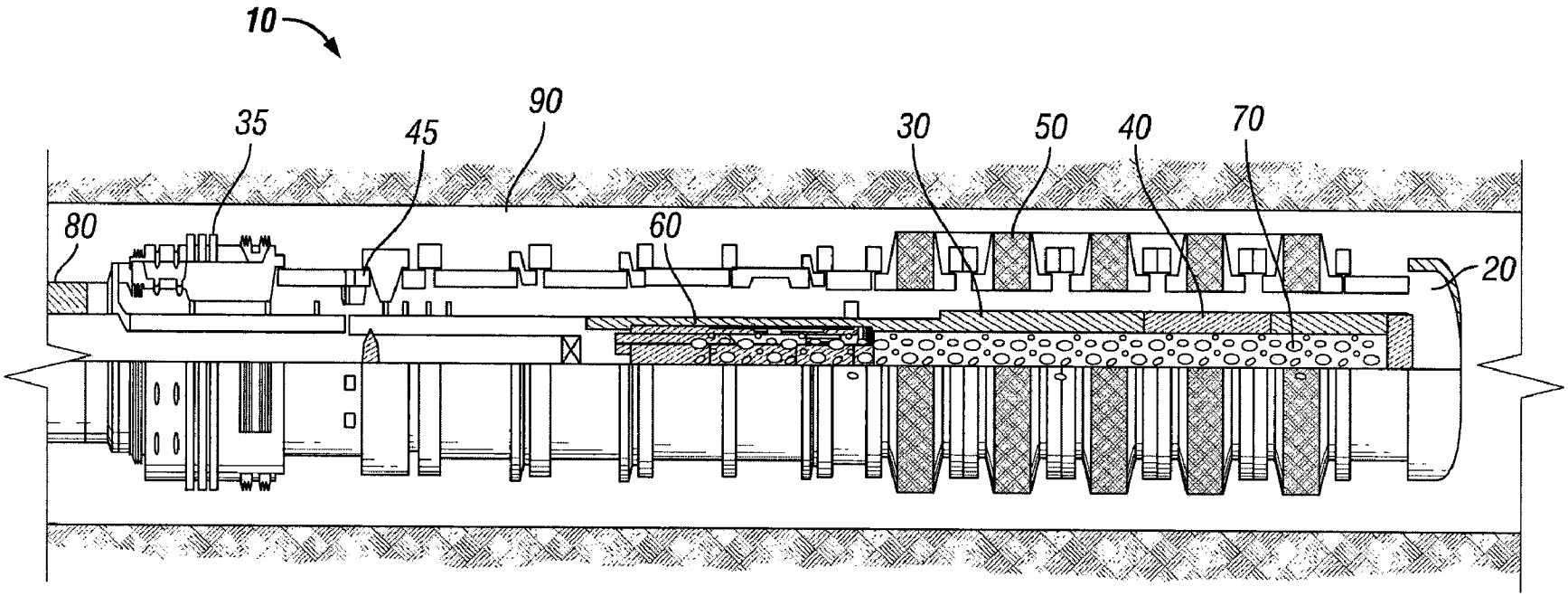
FIG. 2 is a cross sectional view of the low drag flotation system of FIG. 1 showing air trapped within washpipe.
Figure 3:
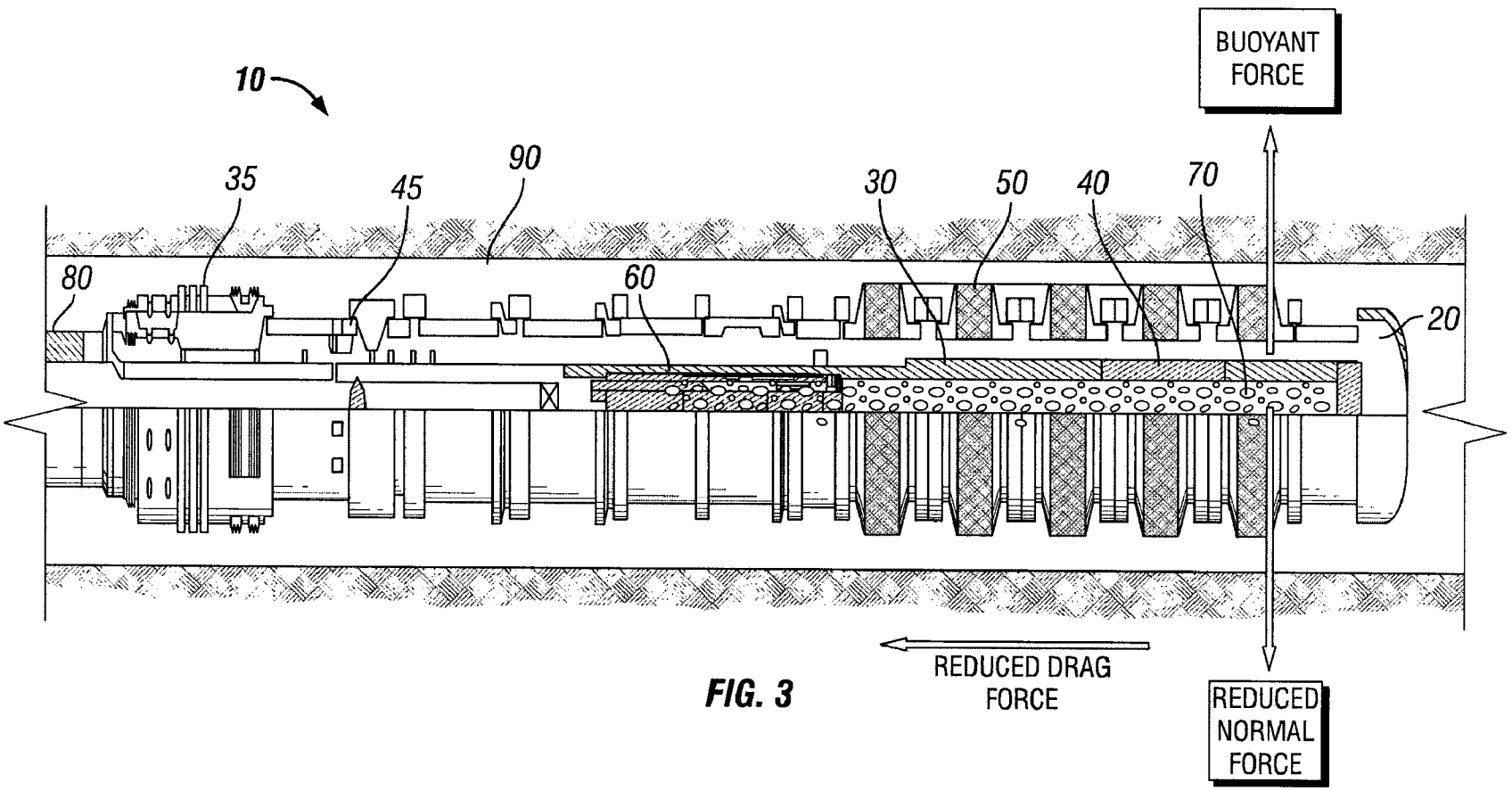
FIG. 3 is a cross sectional view of the low drag flotation system of FIG. 2 showing the effect of the buoyant force on drag force.

FIG. 2 illustrates the trapped air or inert gas 70 within the washpipe 30 that provides the necessary buoyant force for flotation. The trapped air or inert gas 70 may be either compressed or at atmospheric pressure. FIG. 3 illustrates the buoyant force caused by the trapped air or inert gas 70 within the washpipe 30 and the related reduced normal force generated by the system. The reduced normal force of the system is the weight of the screen system less the buoyant force created by the trapped air or inert gas 70. As such, consider the following:

N=Normal force of conventional system

N*=Normal force due to buoyant force exerted by trapped air or inert gas of present invention W=Weight of screen assembly F*=Upward buoyant force with trapped air or inert gas of present invention F=Upward buoyant force of a conventional system If $F^*>F$ and $N=W-F$ and $N^*=W-F^*$, therefore (1) $N>N^*$ The reduced normal force reduces the drag force acting against the system, the drag force being the product of the normal force times the drag coefficient of the well bore. The reduced drag force allows the system to be moved further down the horizontal well under its own weight due to higher available hook loads, as the graphs and simulations in FIGS. 5A-B and 6A-B illustrate. Consider the following:

$\mu C$=Drag coefficient of the well bore.

Fd*=Drag Force using LDFS

Fd=Drag Force of a conventional system

According to proposition (1) $N>N^*$ and:

$Fd^*=\mu C\times N^*$ and $Fd=\mu C\times N$

Therefore:

$Fd>Fd^*$

Figure 4:
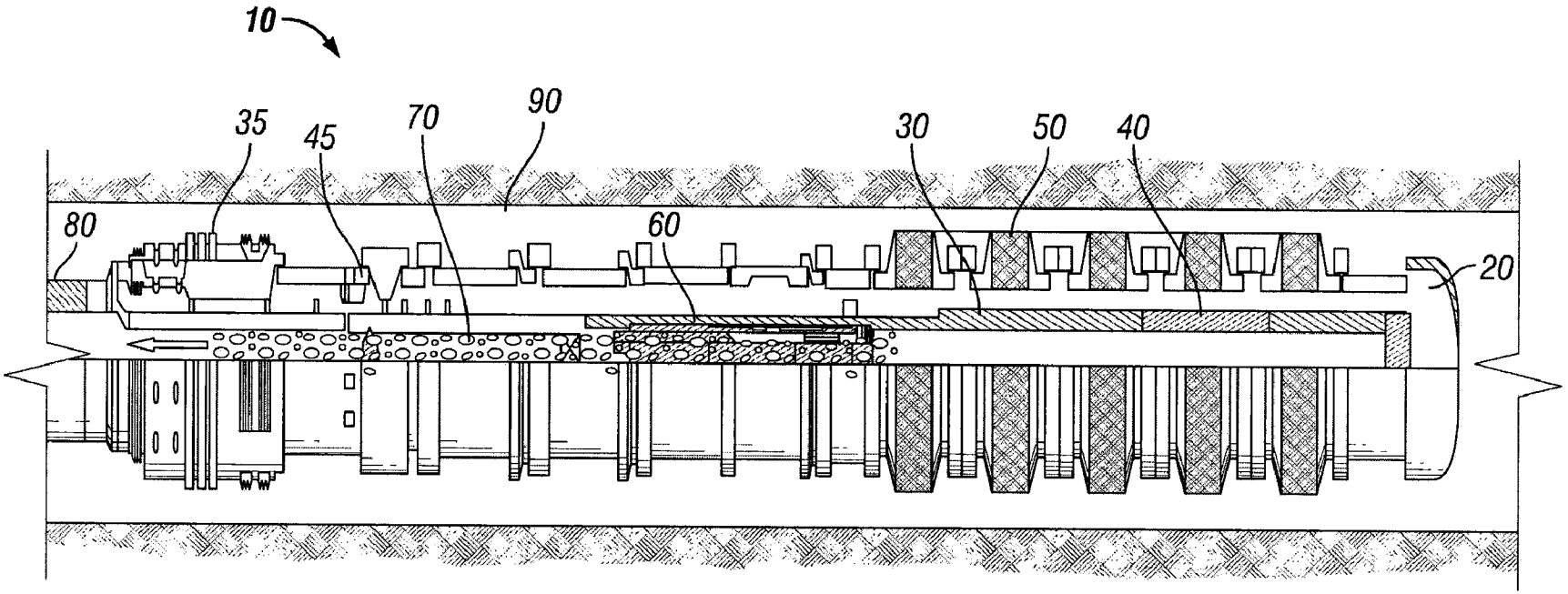
FIG. 4 is a cross sectional view of the low drag flotation system of FIG. 2 showing circulation of trapped air back through the well.

FIG. 4 illustrates the circulation of the trapped air or inert gas 70 from the washpipe 30 back out through the well bore after hydraulically actuated valves 40 and 60 have been opened. Depicted here as the Lo Drag Flotation valve opened by increasing the pressure inside the workstring and washpipe and the Differential Valve opened by increasing the differential pressure against the valve. Hydraulically actuated rupture disk valves and differential valves are known in the art. One of skill in the art will appreciate that the air may be circulated out of the washpipe by circulating fluid down the annulus, through the differential valve and up the washpipe and workstring or by circulating fluids down the workstring and up the annulus.

Figure 5A:
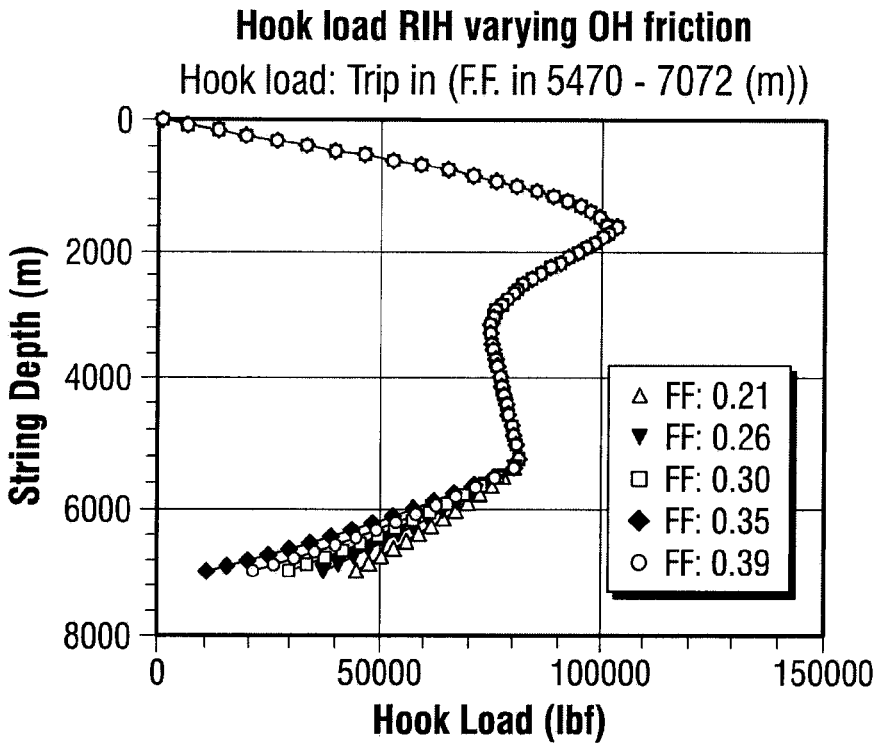
FIGS. 5A-B are graphs of simulated hook load while running in the hole of a horizontal well.
Figure 5B:
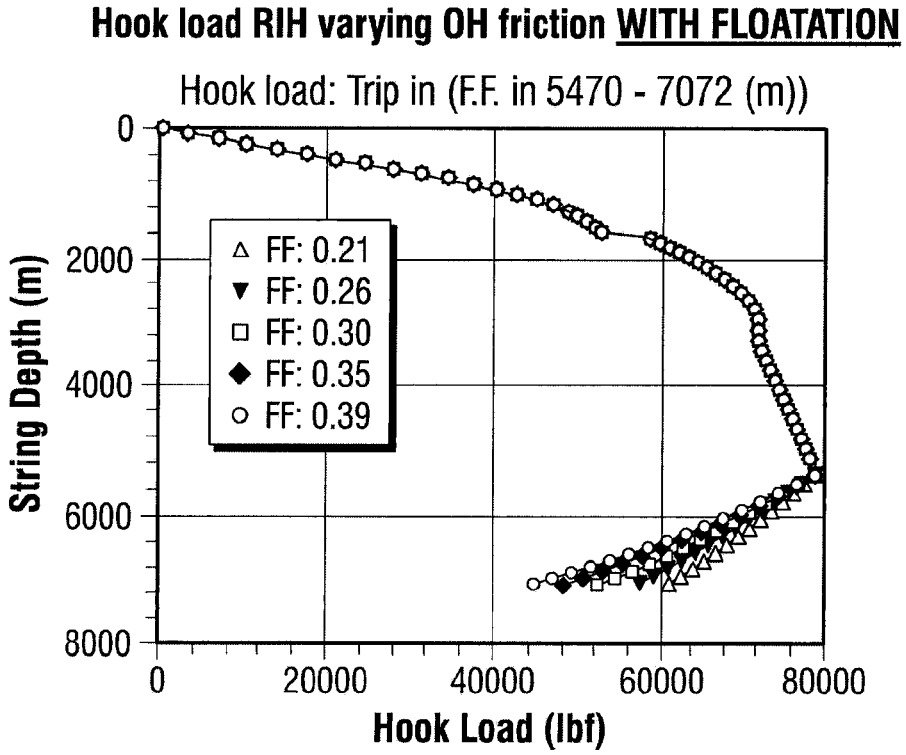

FIG. 5A illustrates a simulated hook load of a pipe string while running in the hole of a horizontal well without the benefit of flotation. The graph shows the simulated hook loads for different friction factors ranging from 0.21 to 0.39. These values represent the friction factors estimated for the open hole section of the simulated well bore, the open hole section extending from 5470-7072 meters (see FIGS. 6A-B). As illustrated, the hook load significantly decreases as the pipe string depth increases. If the hook load decreases to zero, the pipe string could not be lowered any further into the well. FIG. 5B shows the same well simulation with flotation and shows a much higher hook load at the end of the open hole section of the well bore. Thus, at least partially floating a pipe string into the well bore allows the pipe string to be run furthered into a horizontal well due to the lower drag forces being exerted on the string. As a result, longer sections of horizontal well bores may be protected with screens using the present invention.

Figure 6A:
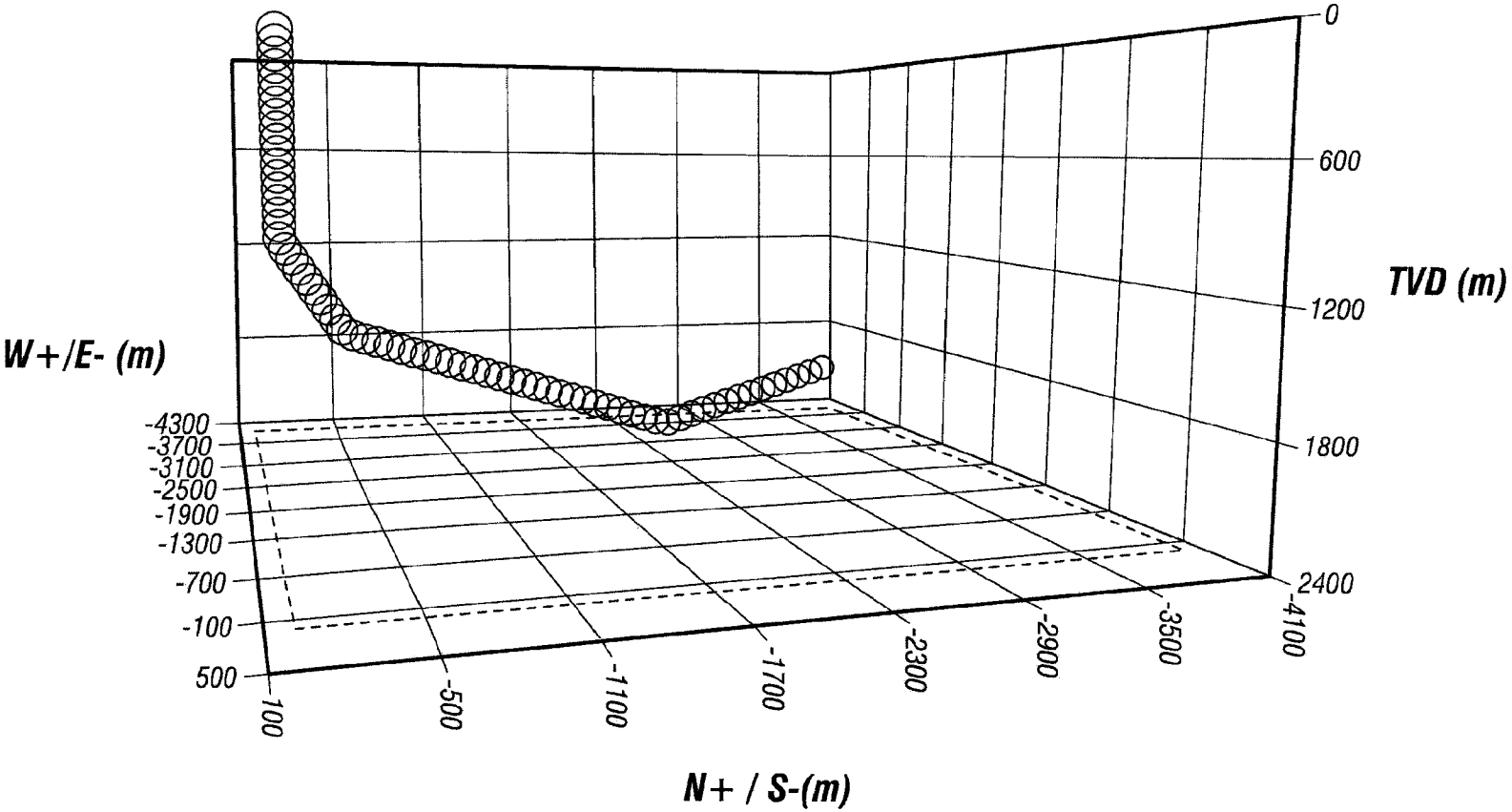
FIGS. 6A-B represent the wellbore schematic and three dimensional depiction of the well used for the simulated hook loads shown in FIGS. 5A-B.
Figure 6B:
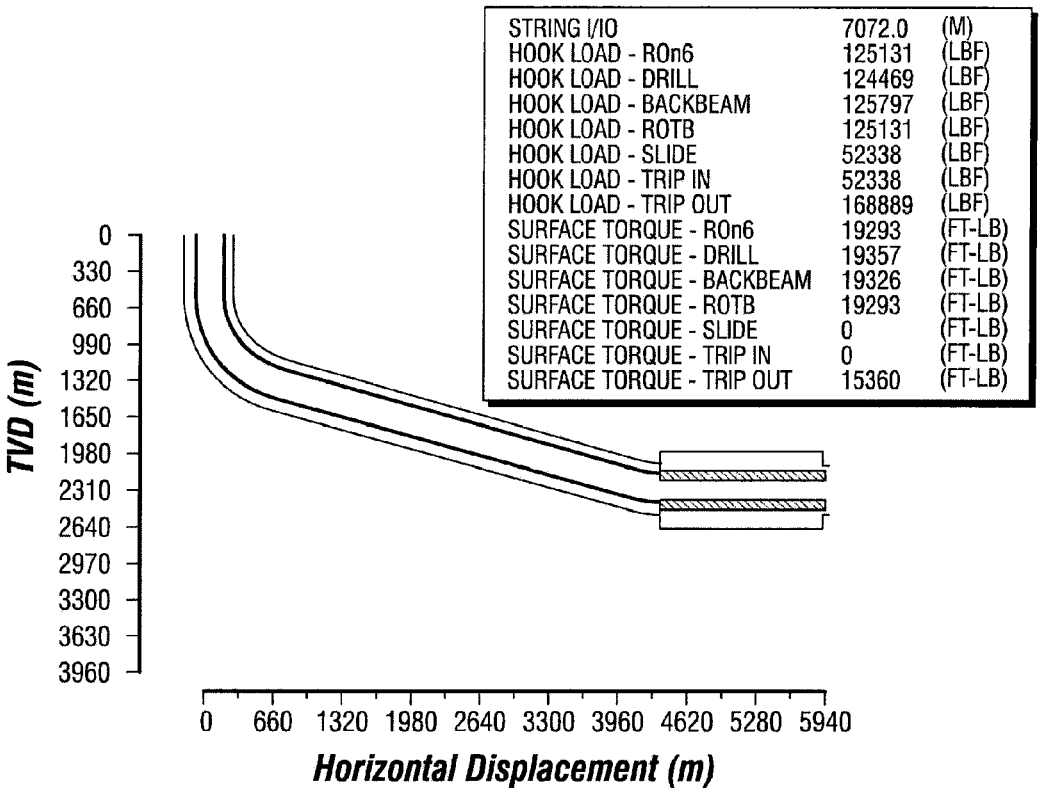

FIGS. 6A-B represent the well bore schematic and three dimensional depiction of the well used for the simulated hook loads shown in FIGS. 5A-B.

The present invention includes a method for reducing the drag force on a pipe string while placing a screen assembly in a horizontal well. A preferred method comprises picking-up and making-up the desired length of the screen assembly and suspending the screen assembly in the rotary table of a drilling or workover rig. The method further includes picking-up and making-up a washpipe assembly and trapping air (or other suitable gas) inside at least a portion of the washpipe. In a preferred embodiment, the washpipe assembly includes two hydraulically actuated valves installed at the surface to trap air (or other suitable gas) inside at least a portion of the washpipe. The washpipe assembly is then run inside the screen assembly. The method further includes picking-up and making-up of a service tool that attaches to the screen and washpipe assemblies. The complete system is then run into the well on a workstring. The trapped air (or gas) in the washpipe allows the screen assembly to be at least partially floated through the horizontal section of the well bore. Thus, the method includes the step of reducing the drag force acting on the system by at least partially floating the screen assembly through the horizontal section of the wellbore. The screen assembly is set at the desired location within the horizontal section. The method further includes the steps of increasing pressure inside the workstring to open the hydraulically actuated valves in the washpipe. The air trapped within the washpipe is then circulated out of the well.

Although various embodiments have been shown and described, the invention is not so limited and will be understood to include all such modifications and variations as would be apparent to one skilled in the art. By way of example, mechanically actuated valves may be used in the washpipe assembly to trap and release air in the washpipe. Alternatively, a combination of mechanically actuated and hydraulically actuated valves may be used to trap and release air in the washpipe. Accordingly, the invention is not to be restricted except in light of the attached claims and their equivalents.

What is claimed is:

1. A flotation system for reducing drag forces associated with installing a screen assembly in a well, the flotation system comprising:

a service tool connected to a workstring that extends to a surface; and a washpipe assembly positioned inside the screen assembly and connected to the service tool, the washpipe assembly comprising:

a washpipe; and a first valve placed within the washpipe, the first valve being adapted to trap gas within the washpipe, thereby causing the screen assembly to at least partially float within the well, wherein the first valve is proximate an upper end of the washpipe and the system further comprises a second valve proximate a lower end of the washpipe.

2. A system as defined in claim 1, wherein the first and second valves are hydraulic valves which can be moved to an open and closed position.

3. A method for reducing drag forces associated with installing a screen assembly in a well, the method comprising the steps of:

(a) placing a washpipe assembly inside the screen assembly, the washpipe assembly comprising at least one valve adapted to trap gas inside the washpipe assembly;

(b) trapping gas inside the washpipe assembly;

(c) running the washpipe and screen assemblies into the well;

(d) at least partially floating the screen assembly within the well using the trapped gas (e) setting the screen assembly at a desired location within the well;

(f) releasing the gas inside the washpipe assembly and circulating the air out of the washpipe assembly; and (g) retrieving the washpipe assembly from the well.

4. A method as defined in claim 3, wherein the gas is trapped at a surface location.

5. A method as defined in claim 3, wherein step (g) further comprises the step of performing a sand control treatment before retrieving the washpipe assembly from the well.

6. A method as defined in claim 3, wherein the trapped air inside the washpipe assembly is released by increasing a differential pressure against the at least one valve, thereby causing the at least one valve to be actuated in an open position.

7. A method to at least partially float a screen assembly within a well, the method comprising the steps of:

(a) running the screen assembly into the well, the screen assembly comprising a washpipe assembly having gas trapped therein, one or more valves being utilized to trap the gas, the one or more valves configured to move to an open or closed position;

(b) at least partially floating the screen assembly within the well using the trapped gas;

(c) setting the screen assembly at a desired location within the well; and (d) actuating the one or more valves into an opened position, thereby releasing the trapped gas, and circulating the trapped gas out of the well.

* * * * *